United States Patent [19]

Beyer

[11] 4,300,718

[45] Nov. 17, 1981

[54] ENGINE COOLING SYSTEM AIR VENTING ARRANGEMENT

[75] Inventor: Frederick A. Beyer, Southfield, Mich.

[73] Assignee: Ford Motor Company, Dearborn, Mich.

[21] Appl. No.: 138,965

[22] Filed: Apr. 10, 1980

[51] Int. Cl.[3] ..... F01P 7/02

[52] U.S. Cl. ..... 236/34.5; 123/41.09

[58] Field of Search ..... 236/34, 34.5; 123/41.08, 41.09, 41.1; 137/519.5, 533.11

[56] References Cited

U.S. PATENT DOCUMENTS

| | | | |
|---|---|---|---|
| 1,313,522 | 8/1919 | Cressy | 137/519.5 X |
| 2,810,524 | 10/1957 | Puster | 236/34 |
| 2,829,835 | 4/1958 | Branson | 236/34.5 |
| 3,973,729 | 8/1976 | Sliger | 236/34.5 |
| 4,011,988 | 3/1977 | Inagaki | 236/34.5 |
| 4,052,965 | 10/1977 | Morris | 236/34.5 X |
| 4,091,991 | 5/1978 | Sliger | 236/34.5 |

FOREIGN PATENT DOCUMENTS

| | | | |
|---|---|---|---|
| 1401396 | 7/1975 | United Kingdom | 236/34.5 |

*Primary Examiner*—William E. Tapolcai, Jr.
*Attorney, Agent, or Firm*—Robert E. McCollum; Clifford L. Sadler

[57] ABSTRACT

The coolant outlet housing of an engine contains a horizontally movable type thermostat and an air vent bypass passage located in the housing at a point above the thermostat to assure the bleed of air from the coolant to the radiator during the filling procedure, the passage containing a one-way ball check valve to permit the bleed of air but prevent the passage of coolant past a closed thermostat to the radiator.

2 Claims, 4 Drawing Figures

ENGINE COOLING SYSTEM AIR VENTING ARRANGEMENT

Figures 1, 2, 3, 4:
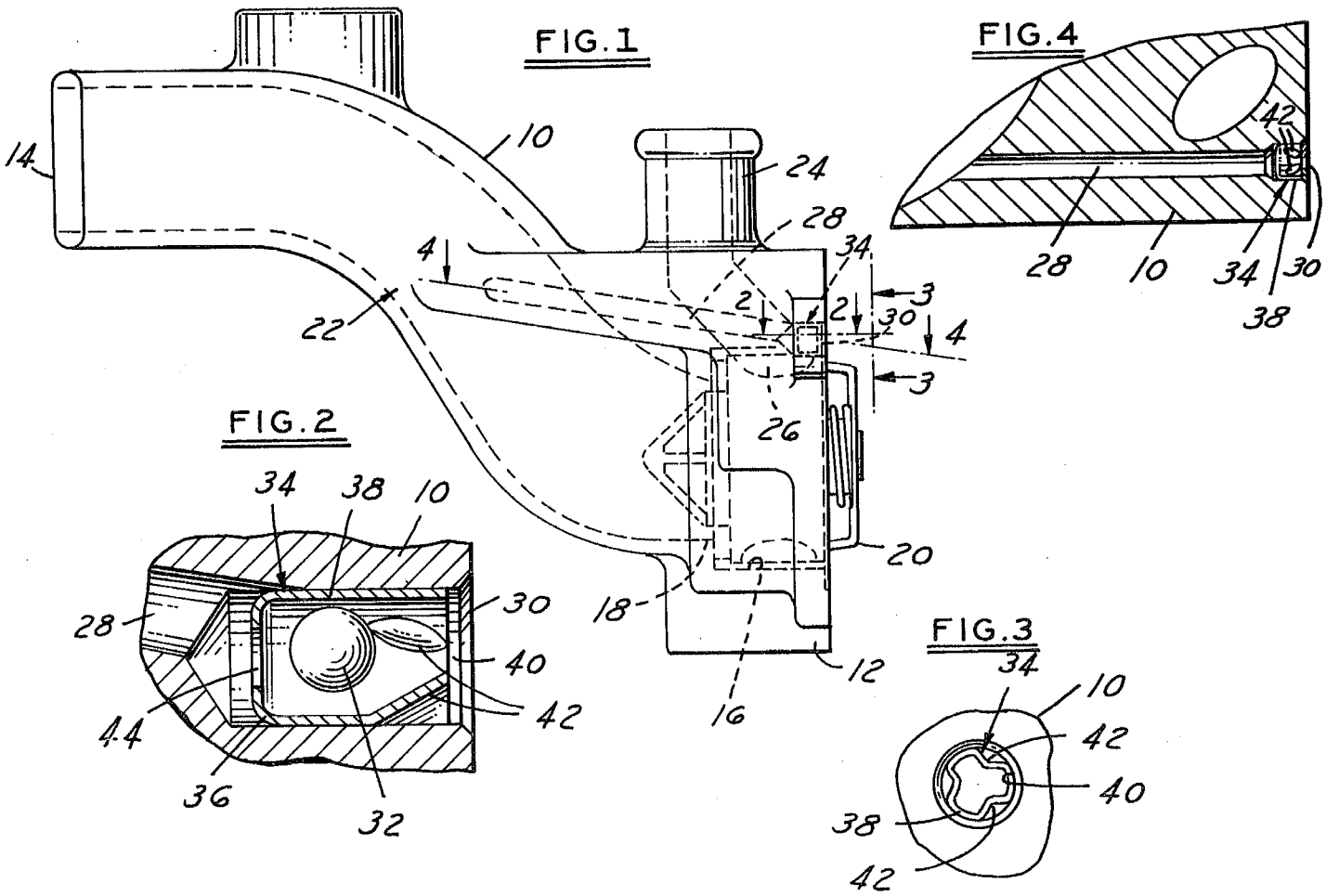

This invention relates in general to an automotive type engine coolant system. More particularly, it relates to an air venting arrangement for purging the coolant system of air pockets that might inhibit the full or complete filling of the cooling system. Still more particularly, it relates to the use and location of an air vent passage that bypasses the conventional thermostat in a manner to provide a purging of the coolant system of air.

Automotive type engine coolant systems are known in which the thermostat contains an opening to permit the venting of air from the coolant passage to the radiator to eliminate air pockets in the cylinder head, for example. Trapped air could subject the engine parts to substantial temperature increases and result in warping or other deleterious effects. Some of these known prior systems have, in the past, also contained so-called "jiggle pin" type check valves, such as is shown, for example, in U.S. Pat. No. 2,810,524, Puster, element 212, and U.S. Pat. No. 2,829,835, Branson, element 82. These rivet like pins are located in the thermostat and fall by gravity to a position permitting flow of air around the pin to eliminate air pockets in the coolant passages. They seat to seal against the flow of coolant past the thermostat in response to the pressure of coolant against the valve. As shown in the Puster and Branson references, the thermostat in these cases is vertically arranged, and any air bubble will rise to the top of the coolant and be vented.

The problems associated with the construction of the prior art is that (1), the thermostat size must be large enough to permit the inclusion of a hole and jiggle pin of sufficient size to provide the proper flow characteristics, (2) the substitution of the whole thermostat is required to change jiggle pin and hole sizes and, (3) the use of a rivet type jiggle pin with its rough surfaces does not provide an adequate seal against leakage of coolant flow and, therefore, may provide less than desirable passenger car heater performance.

Other known forms of air vent check valves and bypass passages and those illustrated in U.S. Pat. No. 3,973,729, Sliger, and U.S. Pat. No. 4,011,988, Inagaki, for example. In Sliger, an opening is made in the side wall of the thermostat housing for a ball check valve housing, the ball falling by gravity to permit the venting of air from the coolant passage, and being movable by coolant to seat and seal against the passage of coolant past the thermostat. The valve and passage are contained within the thermostat per se. In Inagaki, the thermostat closure plate requires an extension in which is located a thermally responsive bypass valve 20. In both of these references, the thermostat is located to operate in essentially a vertical direction so that the location of the air vent is not of prime importance. British Pat. No. 1,401,396 does show a bypass passage containing a jiggle pin that is located not in the thermostat, but in the coolant outlet housing, but again this is a vertical installation type thermostat.

As state previously, this invention relates to a thermostat of a horizontally movable type; that is, one in which the coolant flows past the thermostat in essentially a horizontal direction and thereafter changes more or less to a vertical direction to connect to the tubing leading to the radiator inlet. In this type of installation, location of the air vent is of the utmost importance to assure a complete purging of the cooling system of air. U.S. Pat. No. 4,091,991, for example, illustrates a horizontally disposed thermostat having a pair of air bypass passages or vents 35 that permit venting of air from the coolant flow. In this case, the thermostat is positioned so that at least one of the pockets 35 is located at a high position in the thermostat to allow air trapped in the coolant to be vented before the coolant reaches a level almost to the top of the thermostat. Again, however, it will be seen that since the air venting pocket is located in the thermostat per se, that air can be trapped in the coolant at a level between the air pocket and the housing portion vertically above the thermostat.

It is an object of this invention, therefore, to provide an engine coolant air venting arrangement that eliminates the disadvantages of the known constructions by providing an air venting passage located in the coolant outlet housing itself, and one that is constructed to provide a maximum purging of air from the coolant passages.

It is another object of the invention to provide an engine air venting arrangement of the type described in which the air vent passage is defined by a bore through the coolant outlet housing at a verticalmost point above the outer diameter of the thermostat so that the vent will be positioned at a level higher than the coolant in the passage until the passage has become filled with coolant; the air vent bypass passage being angled upwardly to attempt to maintain a point higher than the level of coolant in the passage on the downstream side of the thermostat.

It is a still further object of the invention to provide an air venting arrangement of the type described in which the air bypass vent passage contains a ball check valve movable in a valve housing in a manner permitting the flow of air into the radiator from the coolant when the thermostat is closed, but a sealing by the ball valve to prevent coolant flow to the radiator.

Other objects, features and advantages of the invention will become more apparent upon reference to the succeeding detailed description thereof, and to the drawings illustrating the preferred embodiment thereof, wherein;

FIG. 1 is a side elevational view of an engine coolant outlet housing embodying the invention; and FIGS. 2-4 are enlarged cross-sectional views, FIGS. 2 and 3 being enlarged, all taken on planes indicated by and viewed in the direction of the arrows 2—2, 3—3, and 4—4, respectively, of FIG. 1.

As stated above, the Figures show a coolant outlet housing 10 for an internal combustion engine of the automotive type. Engine cooling systems are well-known for forcing the flow of coolant from a high point of the engine to the radiator for return to the engine by means of a water pump for further heat exchange. More particularly, the engine coolant system includes a water or coolant outlet housing adjacent the front end of the engine near the top or hottest portion of the engine. A thermostat is generally located at this point to prevent flow of the coolant into the radiator until a predetermined temperature level is obtained. When this happens, the thermostat will open and the coolant will be circulated through the radiator and cooled by air flow therethrough and then sucked back into the engine by the water pump for a further heat exchange action.

The thermostatic controls generally are of two types. One installation locates the thermostat in the end of a vertical conduit so as to be movable vertically to open or close the passage. Air trapped in the coolant behind the thermostat generally escapes through a constant leak type hole in the thermostat or through a jiggle pin type valve previously described above, there being little hinderance to the passage of air since the passage is at the same level as the thermostat seal surface. The second form of installation is one in which a horizontally movable thermostat is provided that connects to a right angled passage leading to the radiator. In this instance, any air trapped behind the thermostat may remain so trapped if an air vent is not provided that is sufficiently higher than the level that the coolant may obtain.

This invention is directed to an arrangement to assure the efficient operation of the horizontal type thermostat by the venting of air from the coolant system during filling. More particularly, FIG. 1 shows a thin-walled, hollow coolant outlet housing 10. It is adapted to be attached at one end 12 to a coolant discharge passage located at the upper portion of an internal combustion engine, not shown. Its other end 14 is adapted to be inserted into the end of a flexible tubular hose or similar conduit, also not shown, that would be connected to the inlet or upper portion of a conventional radiator.

As will be clearly seen, as viewed in FIG. 1, both the inlet and outlet ends 12 and 14 are horizontally disposed. The inlet 12 contains pocket 16 of a diameter slightly larger than that of flow passage 18 to receive therein a known type thermostat 20.

The inlet and outlet ends in this case are joined by a connecting segment 22 that extends diagonally upwardly from the inlet to the outlet end, as shown. The housing also contains a smaller diameter bypass passage 24 having an inlet 26 that connects to end 12 through the pocket 16 and on the upstream side of the thermostat 20. This permits hot coolant flow to be diverted into passage 24 and supplied to the automobile heater system, for example, at all times in a known manner.

Turning now to the invention, the housing is provided with an air vent bypass passage 28. It has an inlet portion 30 located vertically above the outermost vertical point of pocket 16. The passage 28 extends diagonally upwardly towards the connecting segment 22 to open into the same as shown in FIG. 4. Such a construction permits any air trapped in the coolant downstream of thermostat 20 to be vented into the connecting segment 22 and therefrom into the radiator because of its location at a vertical point higher than the highest inlet portion of the coolant flow passage.

The air venting is controlled in this case by a ball check valve 32 enclosed in a cup-shaped valve housing 34 disposed in inlet portion 30. The valve housing is defined by a base portion 36 connected to a surrounding wall portion 38 that is open at the end 40 opposite the base portion 36. The wall portion adjacent the open end is crimped in three locations 42, as best seen in FIG. 3, to a diameter smaller than the diameter of ball 32 to prevent escape of the ball out of the valve housing. The ball valve otherwise is freely movable within the valve housing. The opposite base end 36 of the valve housing contains an air opening 44 of a controlled size smaller than the diameter of ball 32, and constitutes a seat for the ball for sealing off the opening when the ball is forced against it by the coolant.

The operation of the invention is believed to be clear from the above description and a consideration of the drawings. However, in brief, during a filling operation, below a predetermined temperature level, and except for the flow through bypass 24, coolant flow through the thermostat 20 will be stopped due to the closure of the coolant passage by the seating of thermostat 20. However, should an air pocket exist in the coolant, this air can escape through the bypass passage 28 past the ball valve 32, which will fall by gravity away from the opening 44 to permit this. The air will then pass through the bypass passage to the radiator and out the open fill spout. When the air pocket has been eliminated and coolant flow reaches the outermost diameter of the thermostat, further increase in vertical level of the coolant will react against the ball valve 32 to move it to seat against the opening 44 and seal the opening against any flow of coolant past the valve towards the radiator. Therefore, so long as the thermostat 20 remains closed, no coolant flow will occur past the thermostat.

From the above, it will be seen that the invention provides an engine coolant air venting arrangement that permits the elimination of air pockets in the coolant during the filling procedure and, therefore, provides a greater protection to engine parts from overheating. It will be seen that the above is provided by a bypass passage that is located above the highest point of the coolant passage so that air pockets existing in the coolant will be properly vented prior to the passage being completely filled with coolant. It will be further seen that a ball check valve is employed to permit the egress of air from the coolant while preventing any leakage of coolant towards the radiator, which would be detrimental to the heater system efficiency.

While the invention has been shown and described in its preferred embodiment, it will be clear to those skilled in the arts to which it pertains that many changes and modifications may be made thereto without departing from the scope of the invention.

I claim:

1. An air venting arrangement for the cooling system of an automotive type engine that includes a radiator coolant inlet connected by tubing hosing to the engine, the engine having a coolant outlet housing mounted to the engine in communication at one end with the engine internal coolant flow passages and the other end connected to the hosing for flow of hot coolant to the radiator, the outlet housing containing a thermostat horizontally movable to open and close the outlet in response to coolant temperature changes from a predetermined level, the housing having a horizontally oriented inlet portion sealingly receiving the thermostat therein and a horizontally oriented outlet portion connected to the hosing, and a housing connecting segment connecting the portions and extending in a diagonally upward direction from the inlet portion to the outlet portion, a bypass passage extending through the wall of the housing diagonally upwardly from an inlet point adjacent the uppermost outer diameter of the inlet portion containing the thermostat to a point within the connecting segment at a location vertically above the inlet point to the passage to assure a bleed of air through the passage from the coolant bypassing the thermostat, and check valve means in the bypass passage movable by gravity to a position opening the bypass passage in response to the presence of an air pocket in the bypass passage to vent air from the engine to the radiator and movable to a closed sealing position in repsonse to the force of coolant flow against the valve to prevent flow of coolant to the radiator through the bypass passage.

2. An arrangement as in claim 1, the bypass passage containing an inner cup-shaped valve housing defined by a base and enclosing side wall open at the end opposite the base, a ball valve movably received within the valve housing, the wall adjacent the end of the valve housing being crimped to a diameter less than the diameter of the ball valve to retain the valve in the valve housing, the base having an opening therein of a diameter smaller than the ball valve and constituting a seat for the ball valve to prevent leakage of coolant therepast when seated by the pressure of coolant thereagainst, the ball valve moving by gravity to an unseated position in response to the presence of an air pocket in the valve housing to permit the bleed of air into the housing connecting segment and therefrom to the radiator to purge the coolant passages of air.

* * * * *